US005791304A

United States Patent [19]

Taipale

[11] Patent Number: 5,791,304

[45] Date of Patent: Aug. 11, 1998

[54] CYLINDER WALL FUEL INJECTION SYSTEM FOR CROSS-SCAVENGED, TWO-CYCLE COMBUSTION ENGINE

[75] Inventor: Dale L. Taipale, Fond du Lac, Wis.

[73] Assignee: Brunswick Corporation, Lake Forest, Ill.

[21] Appl. No.: 800,027

[22] Filed: Feb. 13, 1997

[51] Int. Cl.[6] ..... F02D 9/08

[52] U.S. Cl. ..... 123/73 C; 123/299

[58] Field of Search ..... 123/65 PD, 65 V, 123/65 W, 65 P, 73 A, 73 B, 73 PP, 73 C, 299

[56] References Cited

U.S. PATENT DOCUMENTS

| | | | |
|---|---|---|---|
| 3,026,862 | 3/1962 | Fisher . | |
| 3,196,926 | 7/1965 | Gartland . | |
| 3,831,563 | 8/1974 | Brittain et al. . | |
| 3,835,822 | 9/1974 | Mickle et al. | 123/41.31 |
| 3,993,030 | 11/1976 | Jaulmes . | |
| 4,088,098 | 5/1978 | Rose et al. | 123/73 A |
| 4,290,394 | 9/1981 | Frank et al. | 123/73 R |
| 4,446,830 | 5/1984 | Simko et al. | 123/276 |
| 4,491,117 | 1/1985 | Koide | 123/541 |
| 4,721,075 | 1/1988 | Kasai | 123/90.23 |
| 4,768,474 | 9/1988 | Fujimoto et al. | 123/73 B |
| 4,768,492 | 9/1988 | Widmer et al. | 123/541 |
| 4,787,343 | 11/1988 | Tuckey | 123/59 EC |
| 4,790,270 | 12/1988 | McKay et al. | 123/73 C |
| 4,941,999 | 7/1990 | Noisier | 261/130 |
| 5,020,485 | 6/1991 | Watanabe | 123/73 C |
| 5,058,548 | 10/1991 | Morikawa et al. | 123/298 |
| 5,103,793 | 4/1992 | Riese et al. | 123/516 |
| 5,115,776 | 5/1992 | Ohno et al. | 123/299 |
| 5,237,966 | 8/1993 | Katch et al. | 123/470 |
| 5,259,344 | 11/1993 | Huany et al. | 123/73 C |
| 5,284,111 | 2/1994 | Geyer et al. | 123/73 C |
| 5,335,635 | 8/1994 | Kadoi et al. | 123/295 |
| 5,389,245 | 2/1995 | Jaeger et al. | 210/129 |
| 5,404,856 | 4/1995 | Servati | 123/478 |
| 5,553,579 | 9/1996 | Yoshida et al. | 123/73 C |

FOREIGN PATENT DOCUMENTS

0302045 B1 7/1988 European Pat. Off. .

OTHER PUBLICATIONS

A Study of Two–Stroke Cycle Fuel Injection Engines for Exhaust Gas Purification, Yamagishi et al., Automotive Engineering and Exposition, Jan., 1972, pp. 253–272.

Fuel Injection of a Two–Stroke Cycle Spark Ignition Engine, R. Douglas et al., SAE The Engineering Resource for Advancing Mobility, #820952, Aug. 16–19, 1982, pp. 1–14.

(List continued on next page.)

*Primary Examiner*—David A. Okonsky
*Attorney, Agent, or Firm*—Andrus, Sceales, Starke & Sawhill

[57] ABSTRACT

A cross-scavenged, two-cycle internal combustion engine has a low-pressure, cylinder wall fuel injection system that is practical for multi-cylinder marine engines. It also reduces the amount of unburned hydrocarbons in exhaust emissions when compared to a conventional carbureted two-cycle, cross-scavenged engine. The fuel injectors are mounted through the cylinder walls so that the fuel spray contacts a deflector on the piston crown. The fuel vaporizes upon contact, and scavenging air flow from the deflector towards the spark plug electrode convects the vaporized fuel towards the spark plug electrode, thereby reducing the likelihood of short circuiting of unburned fuel through the exhaust port before the exhaust port closes and compression begins. All fuel is injected into the piston cavity before the exhaust port closes. In a multi-cylinder engine, all of the fuel injectors are mounted to have parallel spray axes and coplanar top ends, thus allowing the use of a straight fuel rail and convenient mounting techniques. Low-pressure fuel (e.g., 36 to 100 psi) is provided to the fuel rail and to the injectors, and the operation of the fuel injectors is controlled by an electronic control unit. Two fuel injectors can be provided for each cylinder to provide additional fuel injection capabilities. Various systems are disclosed for supplying pressurized fuel to the fuel rail.

22 Claims, 11 Drawing Sheets

OTHER PUBLICATIONS

Low–Pressure Discontinuous Gasoline Injection in Two–Stroke Engines, Grasas–Alsina et al., SAE The Engineering Resource for Advancing Mobility, #860168, Feb. 24–28, 1986, pp. 1–14.

The Nozzle Location and the Shape of Its Surroundings in the Cylinder of Small Two–Stroke Engine, Francisek et al., SAE The Engineering Resource For Advancing Mobility, #860169, Feb. 24–28, 1986, pp. 1–7.

Mixture injection application for avoiding charge exchange losses in two–strike cycle engines, Kuntscher et al., IMechE, 1989, C372/025, pp. 117–122, Mar. 31, 1993.

Fuel Atomization With Mixture Preparation Systems of SI–Engines, Lenz et al., #885015, pp. 1.109–1.117, May, 1985.

Comparative Investigation on Fuel Feed Methods in Two–Stroke, Cycle Methanol Engine, Kubota et al., SAE International, #922312, Oct. 19–22, 1992, pp. 1652–1659.

Gasoline Direct Injection for a Loop–Scavenged Two–Stroke Cycle Engine, Sato et al., SAE #871690, Sep. 14–17, 1987, pp. 1–14.

Direct Fuel Injection: Piaggio Approach to Small 2T SI Engines, Nuti, SAE #880172, Feb. 29 –Mar. 4, 1988, pp. 1–17.

Low–Pressure Electronic Fuel Injection System for Two–Stroke Engines, Vieilledent, Society of Automotive Engineers, Technical Paper Series, #780767, Sep. 11–14, 1978, pp. 1–14.

200 DFI (Direct Fuel Injected) Service Manual, Brunswick Corp., 90–850153R1, Mar. 1996, p. 36.

FIG. 2A
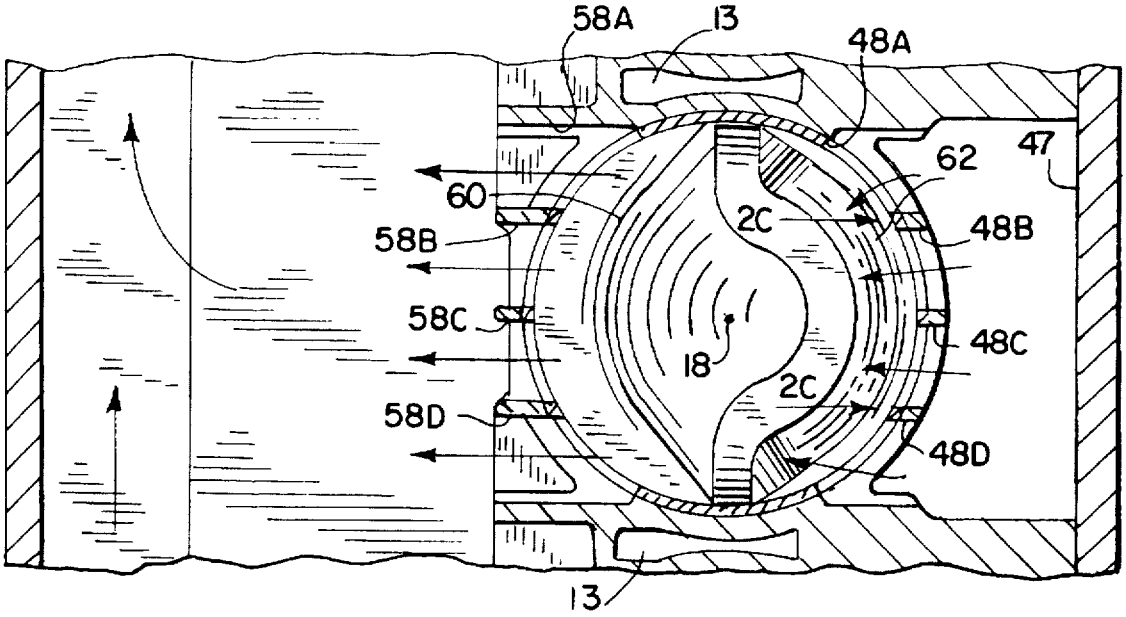
FIG. 2B
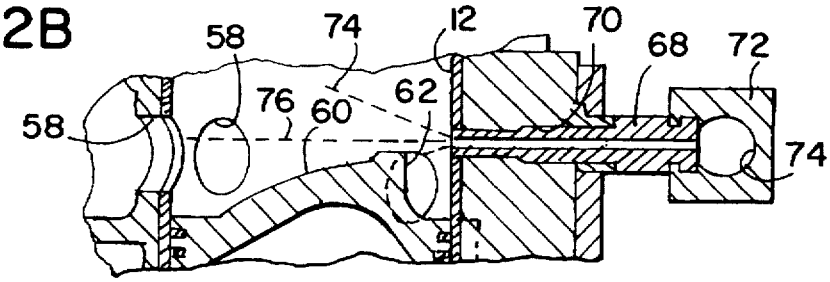
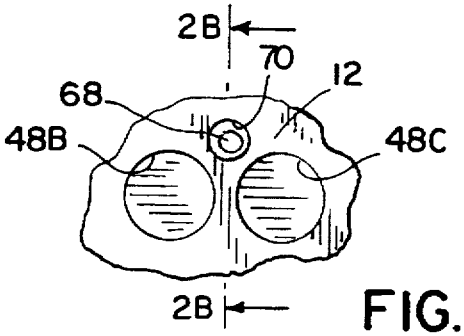
FIG. 2C

FIG. 6
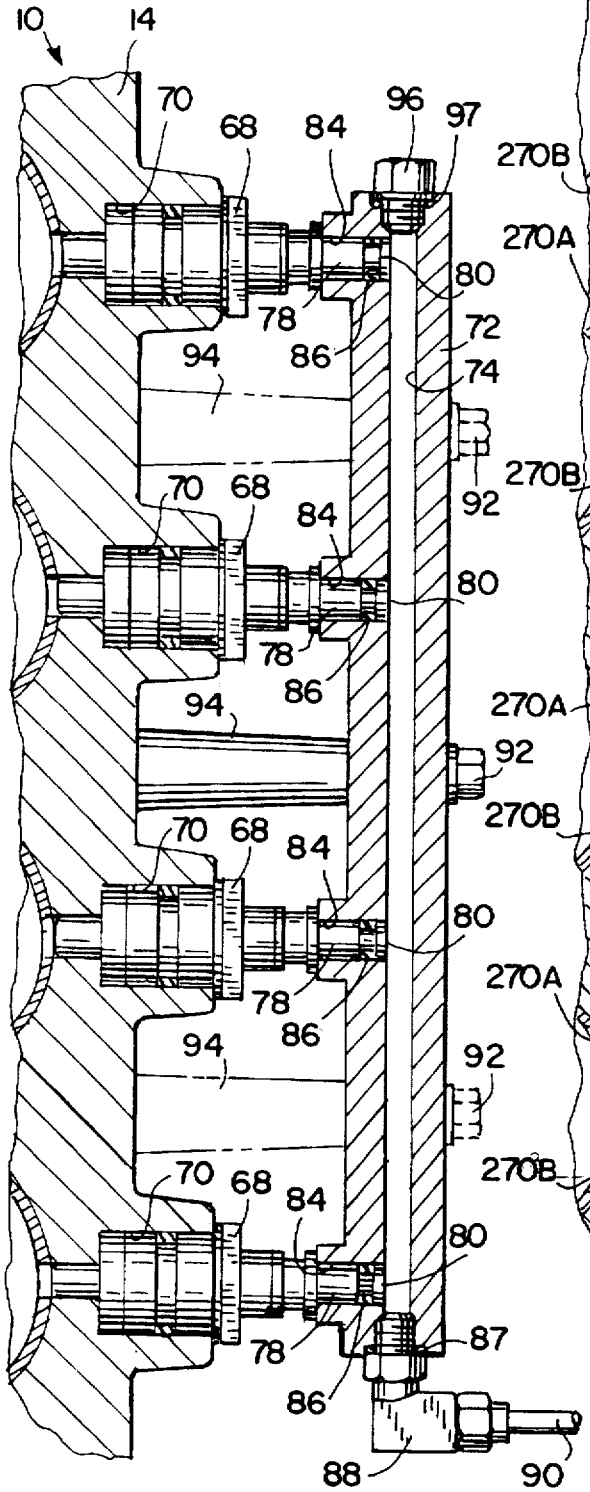
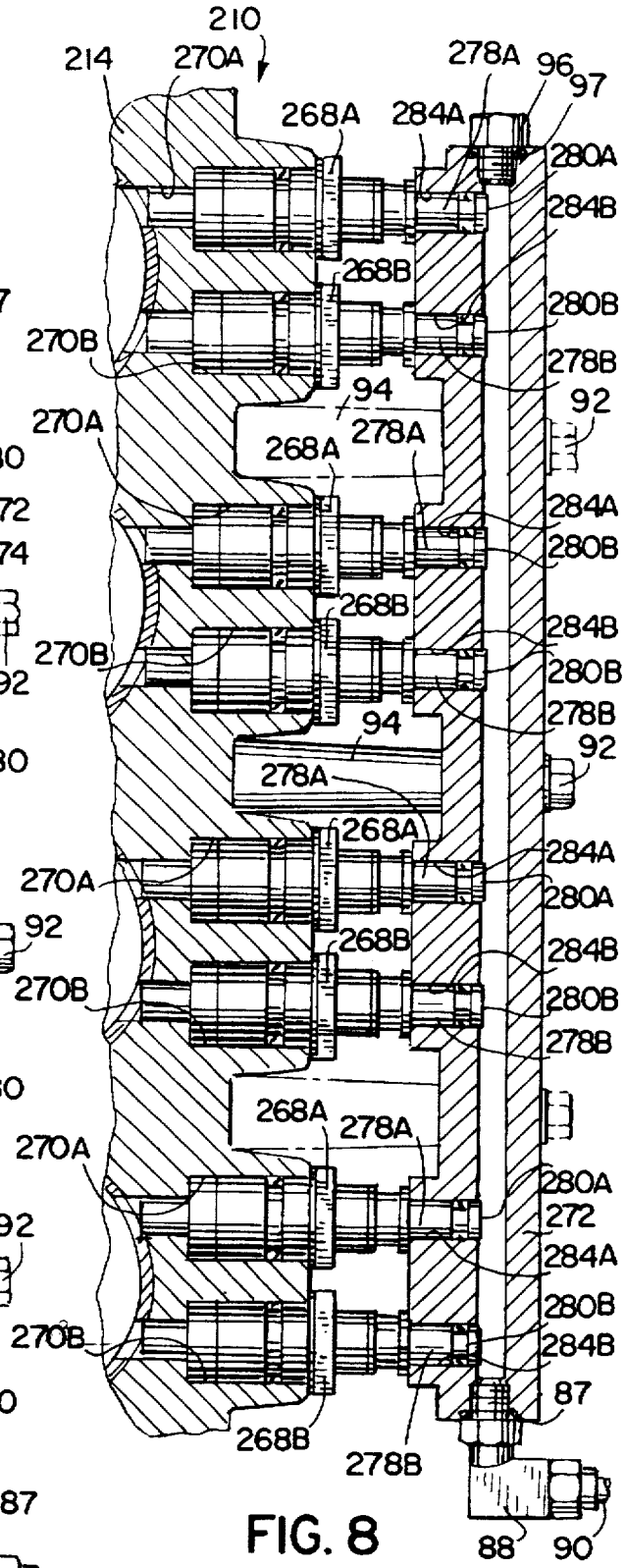
FIG. 8

FIG. 17
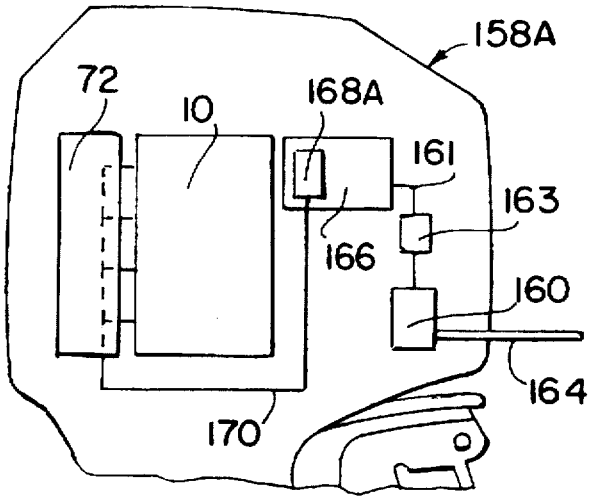
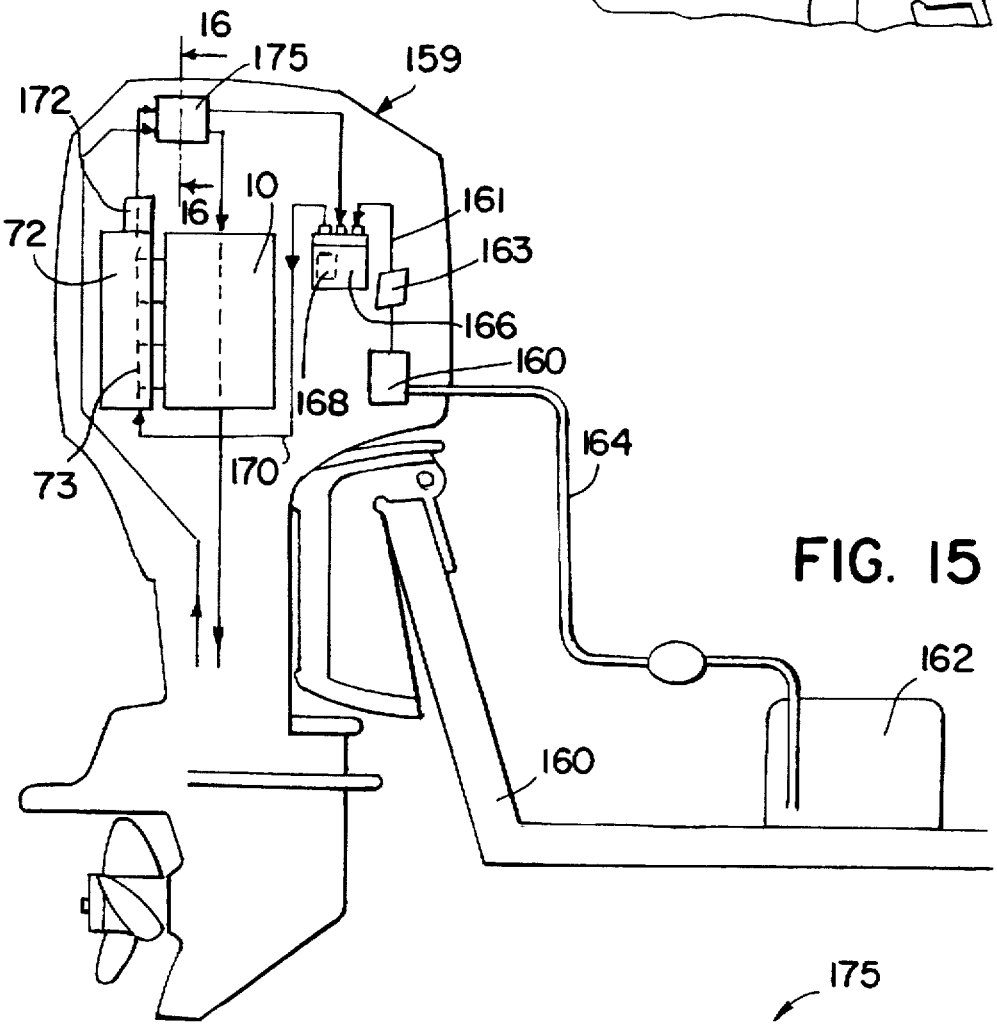
FIG. 15
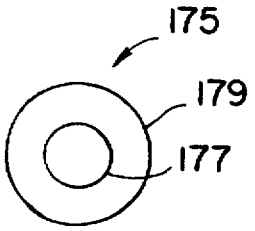
FIG. 16

CYLINDER WALL FUEL INJECTION SYSTEM FOR CROSS-SCAVENGED, TWO-CYCLE COMBUSTION ENGINE

FIELD OF THE INVENTION

The invention relates to fuel supply and fuel injection systems for cross-scavenged, two-cycle internal combustion engines. The invention is particularly applicable to low-pressure, cylinder wall fuel injection systems in two-cycle marine engines.

BACKGROUND OF THE INVENTION

Multi-cylinder, two-cycle internal combustion engines are commonly used in the marine industry for propulsion. Two-cycle engines are often used in outboards and in jet propelled watercraft. Emissions from conventional two-cycle engines having carburetors can contain excessive amounts of unburned hydrocarbons for soon to be implemented environmental regulations, especially when operating at low speeds or idle.

In a two-cycle engine having a carburetor, fuel is mixed with intake air at the carburetor upstream of the combustion cylinders. Therefore, the air used to scavenge exhaust out of the combustion cylinder is mixed with fuel. Because the scavenging process is not perfect, some of the incoming fuel/air mixture passes directly through the exhaust port without being combusted. This phenomenon is called short circuiting, and is a significant source of unburned hydrocarbons in emissions from conventional two-cycle engines.

In loop-scavenged, two-cycle internal combustion engines, it is known that replacing carburetors with electronic fuel injectors to inject fuel directly into the combustion chamber can substantially reduce the amount of unburned hydrocarbons in the engine exhaust as long as fuel injection is timed and coordinated so that very little fuel can escape through the exhaust port during the scavenging process. Injecting fuel into the combustion cylinder after the piston has covered the exhaust port is one way to assure that fuel injected into the combustion cylinder will not short circuit through the exhaust port before the combustion process is completed. However, as the piston moves to cover the exhaust port, the volume in the combustion chamber above the piston is reduced and the pressure within the piston cavity increases greatly. Therefore, at the time of fuel injection, pressure within the piston cavity is relatively high (e.g. 100 psi or greater). Systems that inject fuel after the piston covers the exhaust ports require a high pressure fuel injection system which normally uses a high pressure pump to facilitate injection of fuel into the high pressure environment within the piston cavity during compression.

On the other hand, relatively low-pressure fuel injection systems (e.g. 36 to 100 psi) can be used to inject fuel into the combustion chamber before the piston covers the exhaust port when pressure in the combustion chamber is nearly ambient. It is known to have fuel injectors mounted through the cylinder wall, i.e. cylinder wall fuel injection systems (CWI), of a loop-scavenged engine. Such a low-pressure cylinder wall fuel injection system can use conventional, low cost fuel injectors without sacrificing proper control over fuel spray injection into the piston cavity. However, in such a system it is important to coordinate fuel injection so that the injected fuel does not short circuit, and directly pass through the exhaust port unburned. The coordination of fuel injection is complicated due to the various fuel requirements of the engine over various engine operating speeds and throttle settings. For instance, fuel requirements while the engine is idling are substantially different than fuel requirements when the engine is accelerating or operating at top speed.

Cross-scavenged, two-cycle engines are practical in many marine applications. In order to reduce emissions from cross-scavenged, two-cycle internal combustion engines, it is desirable to provide an effective and practical low-pressure fuel injection system for such engines.

BRIEF SUMMARY OF THE INVENTION

The invention is a low-pressure, cylinder wall fuel injection system for a cross-scavenged, two-cycle internal combustion engine that optimizes the direction of fuel injection into the piston cavity to reduce the potential of short circuiting unburned fuel through the exhaust port both when the engine is idling, and when the engine is running at higher speeds. The system is a practical, low cost alternative to high-pressure fuel injection systems for two-cycle internal combustion engines.

In one aspect, the invention involves the specific location of the fuel injector through the wall of the combustion cylinder in a cross-scavenged engine. In a cross-scavenged engine, combustion products exhaust from the combustion chamber through a plurality of exhaust ports on a first side of a longitudinal cylinder axis passing through the combustion cylinder. Scavenging air enters the piston cavity through a plurality of transfer ports passing through the cylinder wall on the other side of the longitudinal cylinder axis. Air flow from the transfer ports into the piston cavity generally is directed at the exhaust ports at the moment scavenging air enters the combustion chamber from the transfer ports. To create flow patterns through the piston cavity sufficient for scavenging purposes, a piston in a cross-scavenged engine has a piston crown with a deflector from the piston crown towards top dead center (i.e. towards the combustion chamber where the spark plug ignition electrode is located). In accordance with the invention, a fuel injector is mounted through the wall of the combustion cylinder so that the spray axis of the fuel injector enters through the combustion cylinder wall at a distance from top dead center that is farther than a minimum distance between a top edge of the exhaust ports and top dead center. With this configuration, much of the fuel spray impinges on the piston deflector. The piston crown, and in particular the deflector, is very hot when the engine is operating, and the liquid fuel droplets vaporize upon contacting the piston crown/deflector, thereby enhancing combustion efficiency and helping to cool the deflector on the piston crown. After the fuel vaporizes on the deflector of the piston crown, scavenging air flows from the transfer port having been deflected towards top dead center by the deflector on the piston crown convect the vaporized fuel towards the spark plug ignition electrode in the combustion chamber and away from the exhaust port. If it is desired to have additional fuel injected into the combustion cylinder, two fuel injectors can be used to supply fuel to each cylinder in the same manner.

In the preferred embodiment, the exhaust ports are located longitudinally slightly closer to top dead center than the transfer ports. The spray axis for the fuel injector is also slightly farther from top dead center than the top of the exhaust ports. This means that all fuel is injected into the piston cavity before the exhaust ports close. Thus, low-pressure, fuel injectors can be used reliably. Also, the likelihood of short-circuiting unburned fuel through the exhaust port is reduced because most of the fuel spray cone is directed either at the deflector on the piston crown or towards the spark plug ignition electrode at top dead center.

The fuel injectors are preferably mounted through the combustion cylinder wall so that the spray axis of the fuel injector is between a positive of 10 degrees and a negative of 5 degrees with respect to a plane at normal to the longitudinal cylinder axis. It has been found that optimally, the spray axis of the fuel injectors is parallel to the plane normal to the longitudinal cylinder axis.

It is desirable that the spray axis of all of the fuel injectors be parallel to enable the use of a straight fuel rail. The preferred fuel rail has a common fuel canal that provides pressurized fuel (e.g., 36 to 100 psi) to each of the fuel injectors. An electronic control unit controls the operation of the fuel injectors at a constant pressure by opening and closing the fuel injectors. The straight fuel rail provides a simple, effective way to secure fuel injectors in place on the engine. To use a straight fuel rail, the inlet stem for each of the fuel injectors should have a top end that is coplanar with the top ends of the other fuel injectors. The straight fuel rail is conveniently positioned over the coplanar top ends of the fuel injectors. It is preferred that the fuel rail be secured to mounting bosses on the engine block with the fuel injectors disposed between the fuel rail and the engine block. Such a system is particularly easy to service, especially if the fuel rail is easily accessible.

In another aspect, the invention provides a system for supplying pressurized fuel (e.g., 36 to 100 psi) to the fuel rail which is suitable for the low-pressure, cylinder wall fuel injectors. In a watercraft having a fuel tank and a cross-scavenged, two-cycle engine located in an engine compartment (preferably between a hull and a deck), the fuel supply system preferably includes a fuel pump located in the fuel tank, a pressurized fuel line from the fuel pump to the fuel rail, a pressure regulator that regulates the pressure in the pressurized fuel line, and an electronic control unit that controls the operation of the fuel injectors. Preferably, a pressure sensor senses the fuel pressure in the pressurized fuel line and creates a signal that is monitored by the electronic control unit. The electronic control unit preferably limits engine spark advance if the pressure sensor indicates insufficient fuel pressure for proper engine performance, thus preventing engine failure.

Several embodiments of a suitable fuel supply system for a low-pressure, cylinder wall fuel injection system are disclosed for outboard motor having a cross-scavenged, two-cycle engine. The outboard motor fuel supply system includes a first pump that is removably connected to an unpressurized fuel line from a fuel tank located in the boat. The first pump is preferably a low-pressure diaphragm pump driven by oscillating crankcase pressures. The first pump pumps fuel through a fuel filter to a fuel reservoir located within the outboard motor. A second fuel pump is located in the fuel reservoir and supplies pressurized fuel through a pressurized fuel line to the fuel rail. The fuel rail in turns supplies pressurized fuel to the low-pressure fuel injectors. An electronic control unit controls the operation of the fuel injectors.

In one fuel supply system disclosed for a low-pressure, cylinder wall fuel injection system in an outboard motor having a cross-scavenged, two-cycle engine, the electronic control unit controls the pressure of the fuel in the pressurized fuel line and the fuel rail by controlling the operation of the second fuel pump in the fuel reservoir via pulse width modulation. In this system, it may be further desirable to use a pressure regulator in the fuel reservoir to regulate the pressure in the pressurized fuel line from the second pump. In such a system, it should not be necessary to cool the fuel and/or the fuel pump, although if pump heat generation creates problems the fuel and/or the fuel pump should be cooled.

The other fuel supply systems disclosed for a low-pressure, cylinder wall fuel injection system in an outboard motor having a cross-scavenged, two-cycle engine involve the use of a continuous duty fuel pump. In these systems, the second fuel pump providing pressurized fuel to the fuel rail operates continuously. The system requires a mechanical regulator to regulate the pressure in the pressurized fuel line and in the fuel rail, and to allow excessive fuel to flow from the fuel rail through a fuel return line to the fuel reservoir. It is preferred that the fuel reservoir be a vapor separation tank. Furthermore, in these systems, cooling the fuel and/or the continuous duty pump reduces fuel supply vapor problems that can occur because of heat generated by the continuous duty fuel pump. In the first system having a continuous duty pump, the fuel rail includes a cooling duct to allow a cooling media to flow through the fuel rail to cool the fuel flowing through the fuel rail. In the second system having a continuous duty pump, an in-line fuel cooler is provided in the fuel return line to the fuel reservoir. In the third system having a continuous duty pump, a flow of coolant around the continuous duty pump is used to cool the pump itself.

Other objects and advantages of the invention may be apparent to those skilled in the art upon reviewing the drawings and the following description thereof.

BRIEF DESCRIPTION OF THE DRAWINGS

FIG. 2A is a view taken along lines 2—2 and FIG. 1.

FIG. 2B is a view illustrating the preferred location of the fuel injector through the combustion cylinder wall.

FIG. 2C is a view taken in accordance with lines 2C in FIG. 2A.

FIG. 6 is a schematic illustration showing a four-cylinder engine block and an accompanying fuel rail in accordance with the invention.

FIG. 8 is a schematic view illustrating a four-cylinder engine block and an accompanying fuel rail for an engine having two fuel injectors per cylinder.

FIG. 15 is a schematic view in accordance with the invention of a low-pressure fuel supply system for an outboard motor having a cross-scavenged, two-cycle internal combustion engine which has a continuous duty pump and an in-line fuel cooler in a fuel return line.

FIG. 16 is a view taken along line 16—16 in FIG. 15.

FIG. 17 is a schematic view in accordance with the invention illustrating a low-pressure fuel supply system for an outboard motor having a cross-scavenged, two-cycle internal combustion engine which has a pulse width modulated fuel pump.

DETAILED DESCRIPTION OF THE INVENTION

Figure 1:
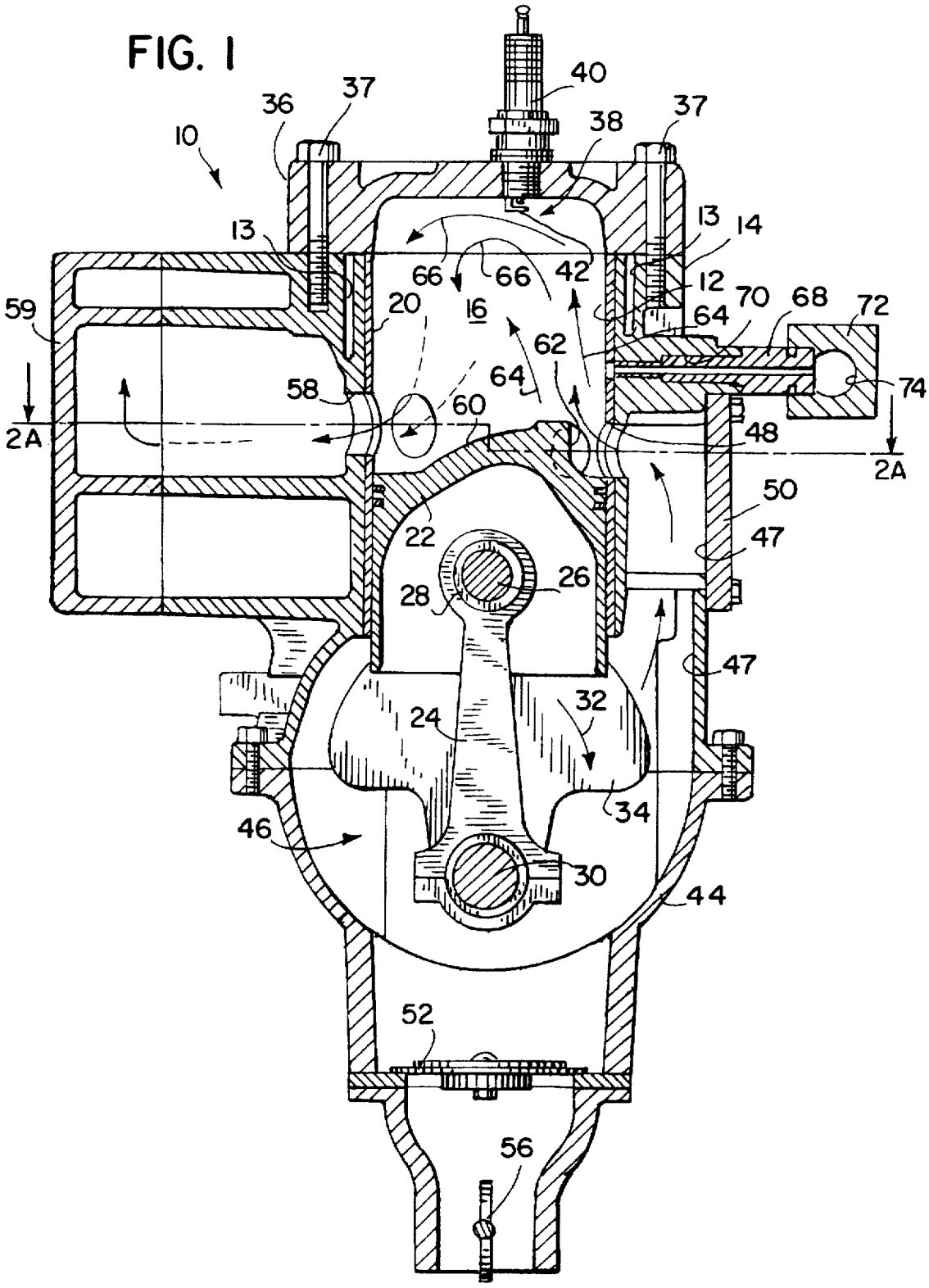
FIG. 1 is a schematic side view of a combustion cylinder for a cross-scavenged, two-cycle internal combustion engine having a low-pressure, cylinder wall fuel injection system in accordance with the invention in which a piston is positioned at bottom dead center.

The invention involves the use of a low-pressure fuel supply system and cylinder wall fuel injection for an internal combustion engine 10. Engine 10 preferably has a plurality of parallel combustion cylinders 12, FIGS. 5 through 8. FIGS. 1–4 illustrate the structure and operation of the low-pressure, cylinder wall fuel injection system in reference to a single combustion cylinder 12.

Referring to FIGS. 1–4, the engine 10 is a cross-scavenged, two-cycle internal combustion engine 10. The engine 10 includes a water-cooled engine block 14. Liquid coolant such as water flows through cooling jackets 13 in the engine block 14 to cool the engine 10. The engine block 14 includes combustion chamber 12 which defines a piston cavity 16 having a substantially cylindrical shape around a longitudinal cylinder axis 18, FIG. 2A. A piston sleeve 20 is preferably fitted into the cylinder block 14 to precisely define the piston cavity 16 as is well known in the art.

A piston 22 reciprocates longitudinally through the piston cavity 16 along the cylinder axis 18 from bottom dead center to top dead center repeatably. The piston is connected to a connecting rod 24 via a piston pin 26 that is attached to the piston 22. The connecting rod 24 includes a bearing mechanism 28 around the piston pin 26 as is known in the art. The connecting rod 24 is attached to a crankshaft 30. When the engine is operating, the piston 22 reciprocates longitudinally through the piston cavity 16 and moves the connecting rod 24 to drive crankshaft 30 in a counterclockwise direction as indicated by arrow 32 on counterweight 34, as well known in the art.

A cylinder head 36 is connected to the cylinder block 14 with fasteners 37. The cylinder head 36 closes off the combustion cylinder 12 to define a combustion chamber 38 that is communication with piston cavity 16 above the piston 22. A spark plug 40 is mounted through the cylinder head 36 so that a spark plug ignition electrode 42 is exposed to the combustion chamber 38.

A crankcase 44 is connected to the cylinder block 14 and defines a charging chamber 46. The charging chamber 46 is in communication with the piston cavity 16 on the side of the piston 22 opposite the combustion chamber 38. The cylinder 12, as shown in FIGS. 1–4 as well as FIGS. 5–8, includes a transfer passage 47, and four transfer ports 48A, 48B, 48C and 48D. The transfer passage 47 passes through the engine block 14 from the charging chamber 46 below the piston 22 to the transfer ports 48A, 48B, 48C and 48D. The transfer ports 48A, 48B, 48C and 48D open into the portion of the piston cavity 16 communicating with the combustion chamber 38, which is above the piston 22 when the piston 22 is bottom dead center, FIG. 1. A transfer passage plate 50 is attached to the engine block 14 to seal the transfer passage 47. Using the transfer plate 50 allows the transfer ports 48A, 48B, 48C and 48D to be easily machined into the combustion cylinder 12.

Figure 3:
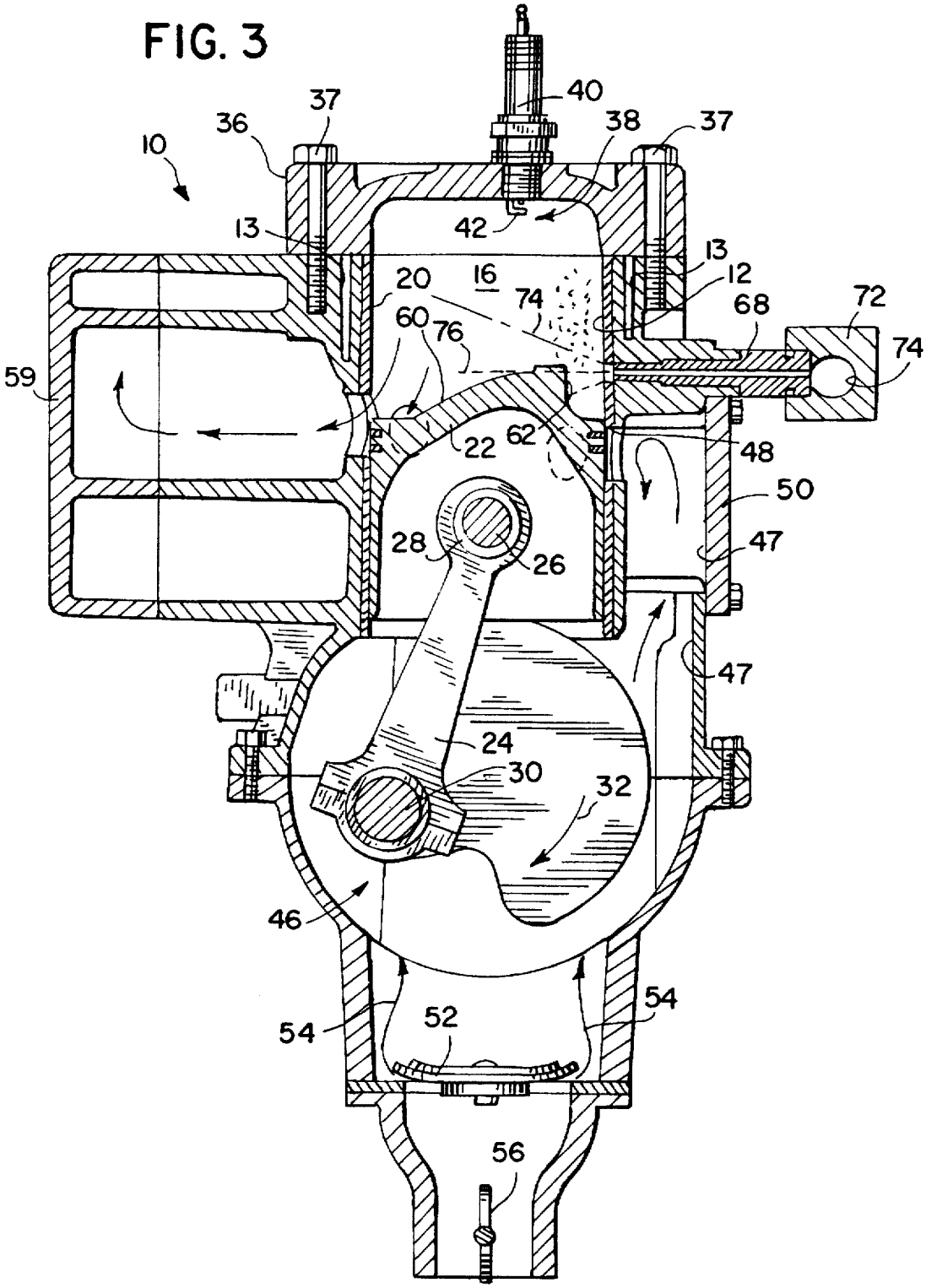
FIG. 3 is a schematic view similar to FIG. 1 in which the piston has moved towards top dead center to partially cover the exhaust port in the combustion cylinder.

Referring in particular to FIG. 3, fresh air enters the charging chamber 46 and the crankcase 44 through one-way reed valve 52 as indicated by arrows 54 when the piston at 22 moves from bottom dead center towards top dead center. The amount of air flowing through reed valve 52 is controlled by the position of throttle body 56 which is position upstream of the one-way reed valve 52.

FIG. 1 illustrates the scavenging process after combustion when the piston at 22 moves through the piston cavity 16 towards bottom dead center. As the piston 22 moves towards bottom dead center, the pressure in the charging chamber 64 increases, thus closing reed valve 52 and pushing fresh air through the transfer passage 47 and through the transfer ports 48 into the portion of the piston cavity 16 above the piston 22 communicating with the combustion chamber 38. The fresh charge of air through the transfer ports 48 flows through the cylinder wall 12 into the piston cavity 16 to begin scavenging combustion products through the exhaust port 58. Combustion products are scavenged through the exhaust ports 58 and exit the piston cavity 16 into an exhaust manifold 59.

Referring in particular to FIGS. 1, 2A, 2B and 2C, the transfer ports 48A, 48B, 48C, and 48D are oriented so that air flowing from the transfer port 48A, 48B, 48C, and 48D into the piston cavity is directed generally towards the plurality of exhaust ports 58A, 58B, 58C, and 58D. It is preferred that the exhaust ports 58A, 58B, 58C, 58D be positioned longitudinally slightly closer to top dead center than the transfer ports 48A, 48B, 48C, 48D. Piston 22 has a piston crown 60 which includes a deflector 62. Airflow from the transfer ports 48A, 48B, 48C and 48D into the piston cavity 16 is generally horizontal with respect to the longitudinal cylinder axis 18 as air initially flows into the piston cavity 16 (although some air flow is directed towards top dead center). The air flow from the transfer ports 48A, 48B, 48C and 48D is redirected towards top dead center by the piston deflector 62 as indicated by arrows 64. The deflector 62 extends longitudinally from the piston crown 60 roughly towards top dead center. The scavenging air flow through the transfer ports 48A, 48B, 48C and 48D is thus redirected by the deflector 62 towards the spark plug ignition electrode 42 in the combustion chamber 38 as indicated by arrows 66.

An electrically controlled, low-pressure fuel injector 68 is mounted in an opening 70 through the cylinder block 14 and/or transfer passage plate 50. The opening 70 through the cylinder block 14 and/or transfer passage plate continues to pass through the cylinder sleeve 20 into the piston cavity 16. The fuel injector 68 receives fuel from a fuel rail 72 at a relatively constant low-pressure, for example 36 to 100 psi. Fuel rail 72 includes a fuel supply canal 74 which supplies fuel to the fuel injector 68. The fuel injector 68 is opened and closed by an electronic control unit. The timing of fuel injection into the piston cavity 16 is dependent on several factors, including throttle position, engine load, engine speed, etc.

Figure 4:
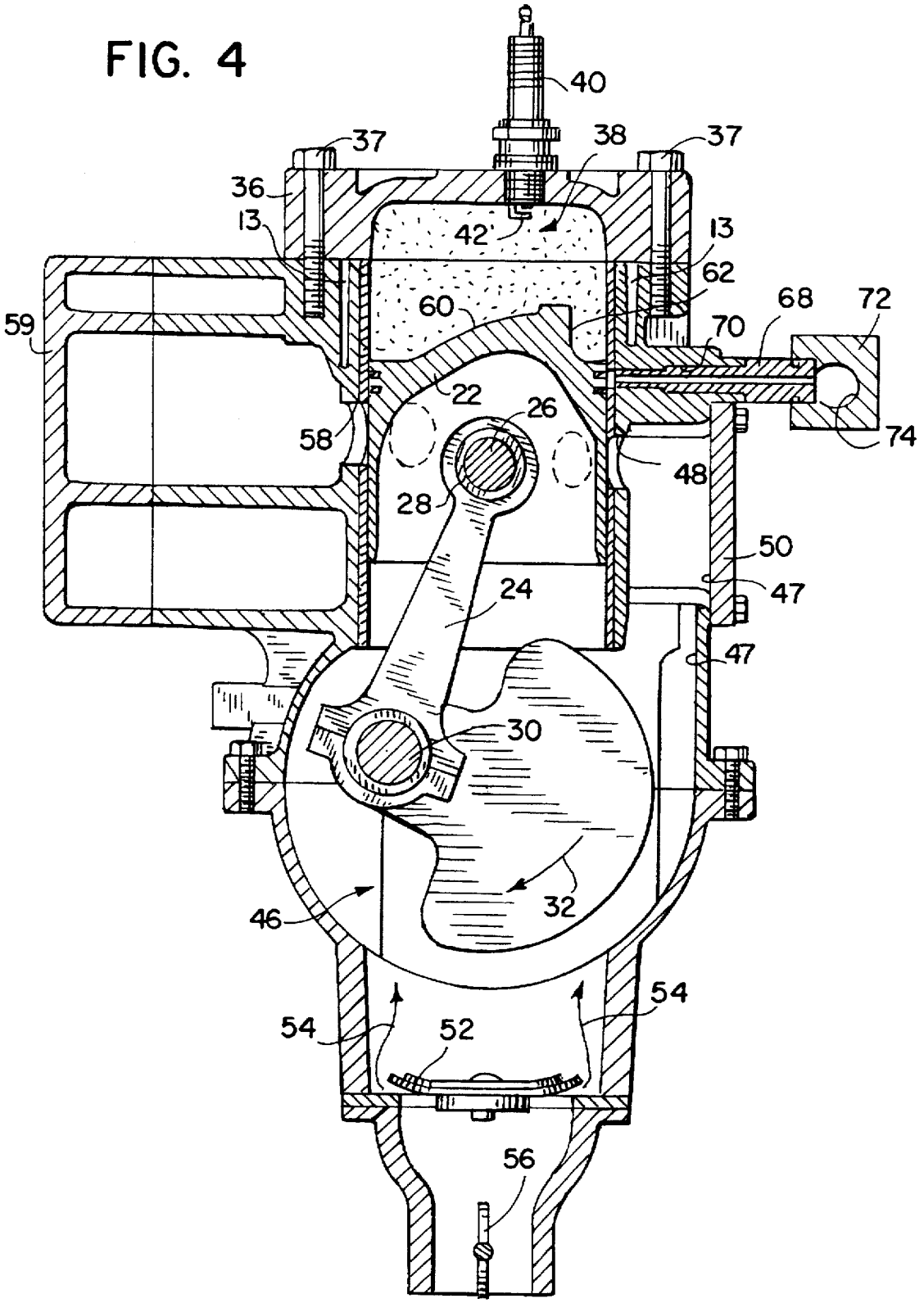
FIG. 4 is a schematic view similar to FIGS. 1 and 3 in which the piston has moved further towards top dead center to completely cover the exhaust port in the combustion cylinder.

The preferred location of the fuel injector 68 is shown in FIGS. 2B and 2C, not as shown in the schematic drawings of FIGS. 1, 3 and 4. Referring in particular to FIGS. 2B and 2C, the opening 70 for the fuel injector 68 should be located farther away from top dead center than the top surface of the exhaust ports 58. With this configuration, all fuel is injected into the piston cavity 16 before the exhaust port 58 closes. This means that the pressure within the piston cavity 16 is very nearly atmospheric during the time fuel is injected into the piston cavity 16. One of the advantages of cylinder wall fuel injection (CWI) in two-cycle engines, especially when fuel injection is accomplished before closure of the exhaust port 58, is that relatively low-pressure fuel injectors 68 can be used without compromising fuel injection efficiency and control.

When the fuel injector 68 is opened, a hollow, cone-shaped spray of fuel 74 is injected from the fuel injector 68 into the piston cavity 16. The opening 70 through the cylinder block 14 and/or transfer passage plate 50 and through the cylinder sleeve 20 is oriented so that the center axis 76 of the fuel spray cone 74 from the fuel injector 68 enters the cylinder 12 at a distance farther from top dead center than the minimum distance between the top of the exhaust port 58 and top dead center. It is preferred that the fuel injector spray axis 76 be directed in a direction parallel to a plain normal to the longitudinal cylinder axis 18. In any event, the fuel injector spray axis 76 should be directed at an angle between a positive 10 degrees in a negative 5 degrees with respect to a plane normal to the longitudinal cylinder axis 18.

Most of the spray 74 of fuel from the fuel injector 68 impinges on the deflector 62 of the piston crown 64, which is very hot when the fuel hits the deflector 62. Many, if not most, of these liquid spray droplets vaporize upon contacting the piston deflector 62. Vaporized fuel bums more efficiently than liquid fuel droplets. In addition, fuel vaporization on the deflector 62 helps to cool the deflector which improves engine durability. Most of the small remaining amount of fuel spray 74 that does not impinge the deflector 62 is sprayed towards the spark plug ignition electrode 42 at top dead center.

When engine 10 is operating at low speed or idling, it is desirable that fuel be injected into the piston cavity 16 late in the cycle (yet before the exhaust ports 58A, 58B, 58C and 58D) to reduce the likelihood of short circuiting unburned fuel through the exhaust ports 58A, 58B, 58C and 58D. FIGS. 1, 3, and 4 generally illustrate the operation of the cylinder wall fuel injection system in an idling engine 10. FIG. 1 shows the piston at bottom dead center, and illustrates that the fresh air has been forced into the piston cavity 16 through transfer passage 47 and transfer ports 48A, 48B, 48C and 48D to scavenge the piston cavity 16 of the exhaust. In FIG. 1, fuel is not yet being injected into the piston cavity 16. FIG. 3 shows the piston 22 during the stroke between bottom dead center and top dead center, and shows fuel being injected into the piston cavity 16 directly onto the deflector plate 62 on the piston crown 60, although a small amount of fuel is sprayed above the deflector 62. Liquid droplets in the fuel spray 74 vaporize upon contact with piston deflector 62. Emissions of unburned fuel through the exhaust ports 58A, 58B, 58C and 58D are minimize because fuel is injected into the piston cavity 16 late in the cycle. FIG. 4 illustrates the piston 22 moving towards top dead center at the beginning of the compression stroke after fuel injection has ceased.

As engines speed increases, more fuel needs to be added to the piston cavity 16, and this requires that fuel injection into the piston cavity 16 begin earlier in the cycle. For instance, at medium or high speeds, it may be necessary to begin spraying fuel into the piston cavity 16 when the piston cylinder 22 is at bottom dead center, FIG. 1, or before. Thus, at medium or high speeds, fuel is sprayed into the piston cavity 16 and contacts the piston deflector 62 underneath the flow of fresh air flowing into piston cavity 16 through transfer ports 48A, 48B, 48C and 48D, in the region where the scavenging air flow is being redirected towards top dead center (i.e. towards the spark plug ignition electrode 42 in the combustion chamber 38). Liquid droplets in the fuel spray will vaporize upon contacting the piston deflector 62, and the ascending flow of air (i.e. arrows 64) from the piston deflector 62 towards the spark plug electrode 42 facilitates convection of the vaporized fuel toward the spark plug electrode 42. Short circuiting of unburned fuel through the exhaust ports 58A, 58B, 58C, and 58D is reduced due to the deflected air flow from the transfer ports 48A, 48B, 48C and 48D which in effect blows vaporized fuel from the piston deflector 62 towards the spark plug electrode 42.

Air flow into the piston cavity 16 through the transfer passage 47 and the transfer ports 48A, 48B, 48C and 48D as shown in FIGS. 1 and 2A occurs mostly as the piston strokes from top dead center to bottom dead center after the piston 22 has at least partially uncovered the transfer ports 48A, 48B, 48C and 48D. Thus, it is practical to locate the fuel injector opening 70 so that the spray axis 76 of the fuel injector 68 is at nearly the same distance from top dead center as the top of the transfer port 48A, 48B, 48C and 48D. If it is possible to nest the fuel injector 68 between the upper portion of two transfer ports 48A, 48B, 48C or 48D so that the spray axis 76 of the fuel injector 68 is below the top end of the transfer ports 48A, 48B, 48C and 48D, such a configuration may be desirable in some engines. In any event, the fuel injector 68 should be positioned so that the spray axis 76 enters into the piston cavity 16 at a distance farther from top dead center than the distance between the top of the exhaust port 58A, 58B, 58C, and 58D and top dead center to ensure that fuel will not be injected into the piston cavity 16 unless pressure within the cavity 16 is nearly atmospheric. It should be appreciated that a cylinder wall fuel injection system as describe thus far not only allows use of low-pressure fuel injectors, but also optimizes the use of air flow and piston crown heat to reduce short circuiting of unburned fuel even when fuel is injected into the cylinder 16 during the piston down stroke or soon thereafter.

Figure 5:
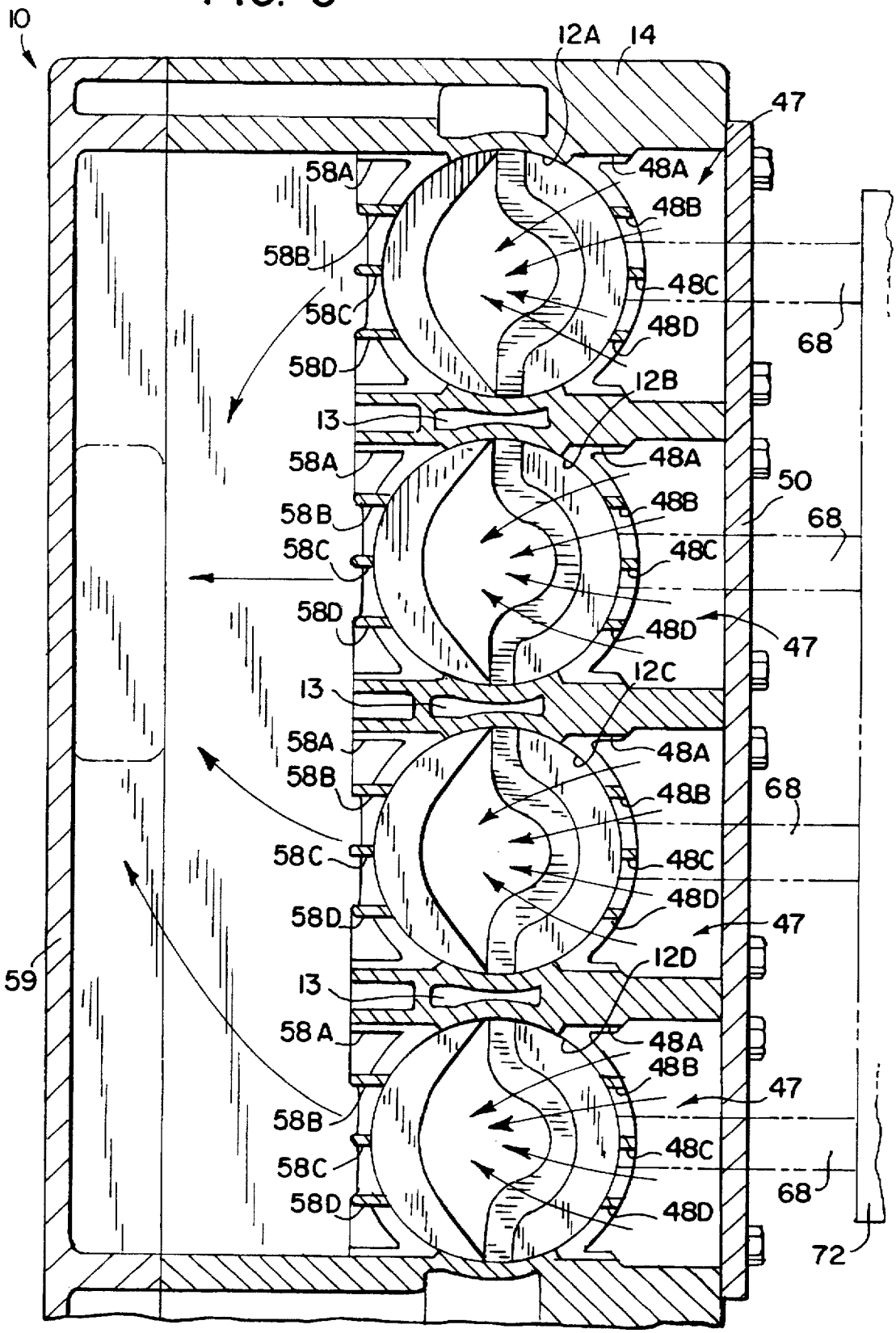
FIG. 5 is a schematic drawing illustrating air flows and fuel injection into a four-cylinder, cross-scavenged, two-cycle internal combustion engine in accordance with the invention.

FIGS. 5–6 illustrate the low-pressure, cylinder wall fuel injection system described in conjunction with FIGS. 1–4 being implemented in a multi-cylinder, cross-scavenged, two-cycle engine 10. FIGS. 5–6 show a four-cylinder engine block 14 having four parallel cylinders 12A, 12B, 12C and 12D. The cylinders 12A, 12B, 12C and 12D are positioned as close together as possible to allow for sufficient cooling via cooling jackets 13 located between cylinders. FIG. 5 shows the exhaust ports 58A, 58B, 58C and 58D leading into an exhaust manifold 59. FIG. 5 also shows that a single transfer passage plate 50 can be used to conveniently close off the transfer passage 47 leading to the transfer ports 48A, 48B, 48C and 48D of the four cylinders 12A, 12B, 12C and 12D.

Referring to FIGS. 6, each of the fuel injectors 68 has an inlet stem 78 extending outward from the engine block 14. The top end 80 of the inlet stem 78 of each fuel injector 68 is coplanar with the top ends 80 of the other fuel injectors 68. The openings 70 in the engine block 14 are configured so that the spray axis of the fuel injectors 68 are parallel to the spray axis of the other fuel injectors 68.

Figure 7:
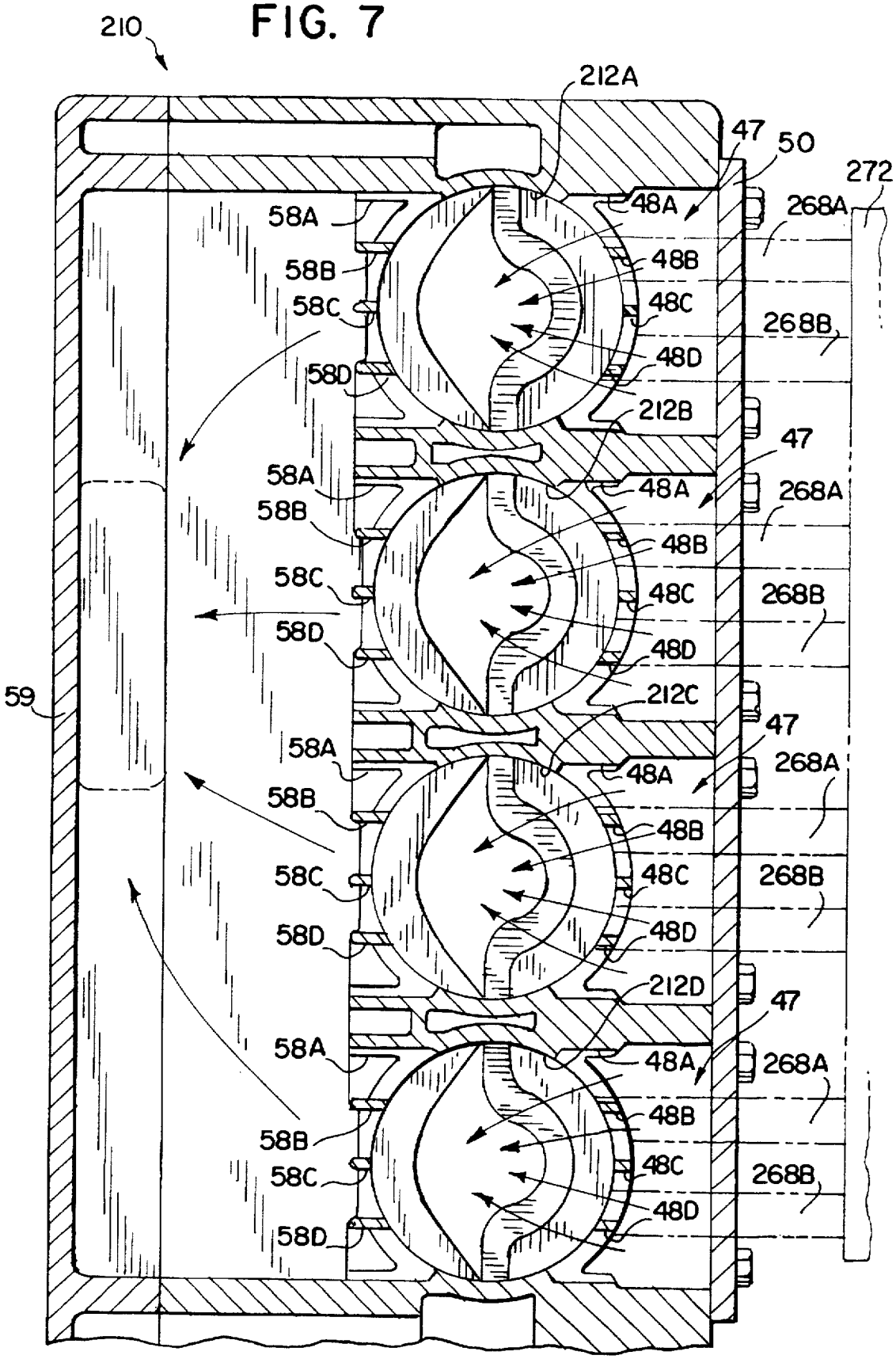
FIG. 7 is a schematic drawing illustrating air flows and fuel injection into a four-cylinder, cross-scavenged, two-cycle internal combustion engine having two fuel injectors per cylinder.
Figure 9:
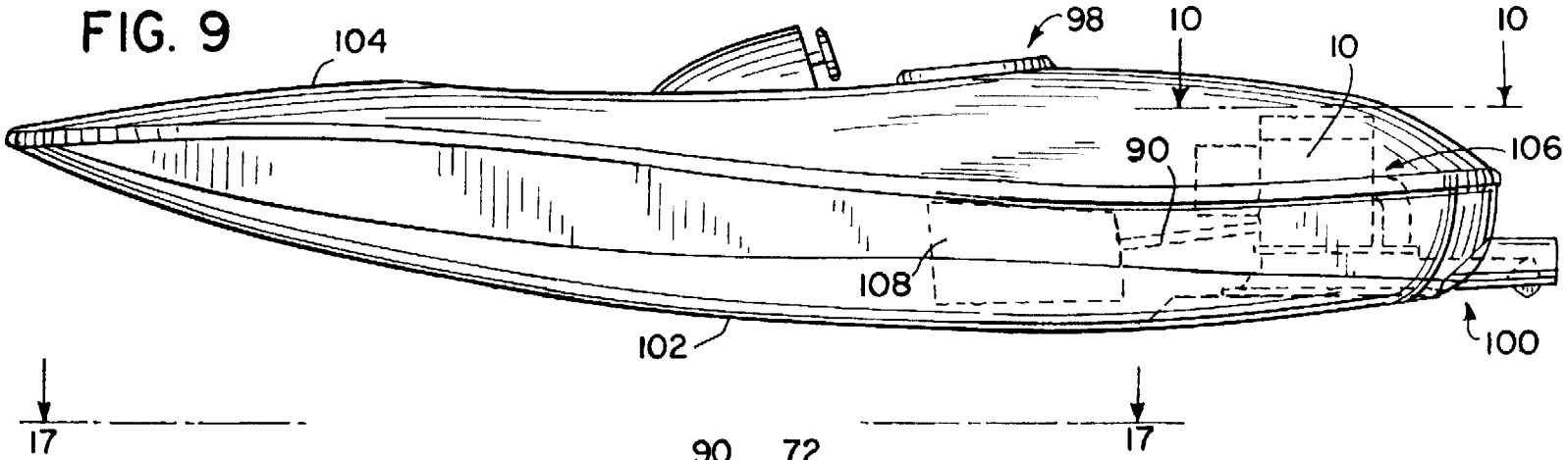
FIG. 9 is a side view of a watercraft having a four-cylinder, cross-scavenged, two-cycle internal combustion engine with a low-pressure fuel supply system and cylinder wall fuel injection as in accordance with the invention.

The fuel rail 72 is straight. The fuel rail 72 has a common straight fuel canal 74 for each of the four fuel injectors 68, along with separate dedicated canals 84 for each fuel injector 68. The dedicated canals 84 are perpendicular to the common straight canal 74. The straight fuel rail 72 is mounted over the coplanar top ends 80 of the fuel injector 68 so that the inlet stem 78 of each of the fuel injectors 68 is received within the corresponding canal 84 in the fuel rail 72. O-ring seals 86 seal the interface between the inlet stem 78 of the fuel injector 68 and the corresponding dedicated canal 84 in the fuel rail 72. Fuel pressurized at a relatively low-pressure, e.g., 36 to 100 psi, is supplied to the fuel injectors through the common fuel canal 74 in the straight fuel rail 72. FIG. 6 shows a fitting 88 being used to attach a fuel line 90 to the fuel rail 72. An O-ring seal 87 seals the interface between the fitting 88 and the common straight canal 74. The fuel rail 72 and the fuel injectors 68 are mounted to the engine block 14 by securing attachment bolts 92 through the fuel rail and into mounting bosses 94 on the engine block 14. FIG. 7 shows a plug 96 and O-ring 97 sealing the common canal 74 and the fuel rail 72 on the side of the fuel rail 72 opposite the fuel line 90. A plugged fuel rail can be used if the fuel pumping system is capable of continuously providing fuel at the desired pressure without requiring continuous flow of fuel through the fuel rail 72.

FIGS. 7 and 8 illustrate an engine 210 similar to that illustrated in FIGS. 5 and 6, except that the engine 210 shown in FIGS. 7 and 8 has been adapted to provide two fuel injectors 268A, 268B for each cylinder 212A, 212B, 212C and 212D in the engine 210. The system shown in FIGS. 7 and 8 may be useful if it is desirable to provide more fuel into each cylinder 212A, 212B, 212C and 212D. The engine 210 in FIGS. 7 and 8 includes two openings 278, 270B through the cylinder block 214 into each cylinder 212A, 212B, 212C and 212D to accommodate two fuel injectors 268A, 268B. The openings 270A, 270B in the engine block 214 are configured so that the spray axis of the fuel injectors 268A and 268B for each cylinder 212A, 212B, 212C, 212D are parallel to one another and are also parallel to the spray axis of the other fuel injectors 268A, 268B for the other cylinders 212A, 212B, 212C, and 212D. Each fuel injector 268A, 268B has an inlet stem 278A, 278B. The top end 280A, 280B of the inlet stems 278A, 278B of each fuel injector 268A, 268B is coplanar with the top ends of 280A, 280B of the other fuel injectors 268A, 268B. The fuel rail 272 is straight, and has a straight common fuel canal 274 for each of the 8 fuel injectors 268A, 268B, along with separate dedicated canals 284A, 284B for each fuel injector 268A, 268B. The dedicated canals 284A, 284B are perpendicular to the common straight canal 274. The straight fuel rail 272 is mounted over the coplanar top ends 280A, 280B of the fuel injectors 268A, 268B so that the inlet stems 278A, 278B of each fuel injector 268A, 268B are received within the corresponding dedicated canal 284A, 284B in the fuel rail 272. Fuel pressurized at relatively low-pressure, e.g. 36 to 100 psi, is supplied to the fuel injectors 268A, 268B through the common fuel canal 274 in a straight fuel rail 272. The fuel rail 272 and the fuel injectors 268A, 268B are mounted to the engine block 214 by securing an attachment bolts 92 through the fuel rail through 272 into mounting bosses 94 on the engine block 214. In other respects, the system 210 shown 210 in FIGS. 7 and 8 is similar to the system shown in FIGS. 5 and 6.

FIGS. 9 through 12 illustrate the use of a four-cylinder, two-cycle, two-stroke, cross-scavenged engine having cylinder wall fuel injection in accordance with the invention being implemented on a watercraft 98 having a jet drive 100. The watercraft 98 shown in FIG. 9 has a hull 102 and a deck 104, both preferable made of fiber reinforced plastic. Engine compartment 106 is located between the hull 102 and the deck 104. An engine 10 in accordance with the invention is located within the engine compartment 106. Fuel tank 108 is located in the engine compartment 106 forward of the engine 10. The engine 10 receives fuel from the fuel tank 108 through a pressurized fuel line 90 (e.g. a constant pressure between 36 and 100 psi). The engine 10 has a vertical crankshaft that is coupled to a jet pump 100 located rearward of the engine 10. The jet pump 100 propels watercraft 98.

Figure 10:
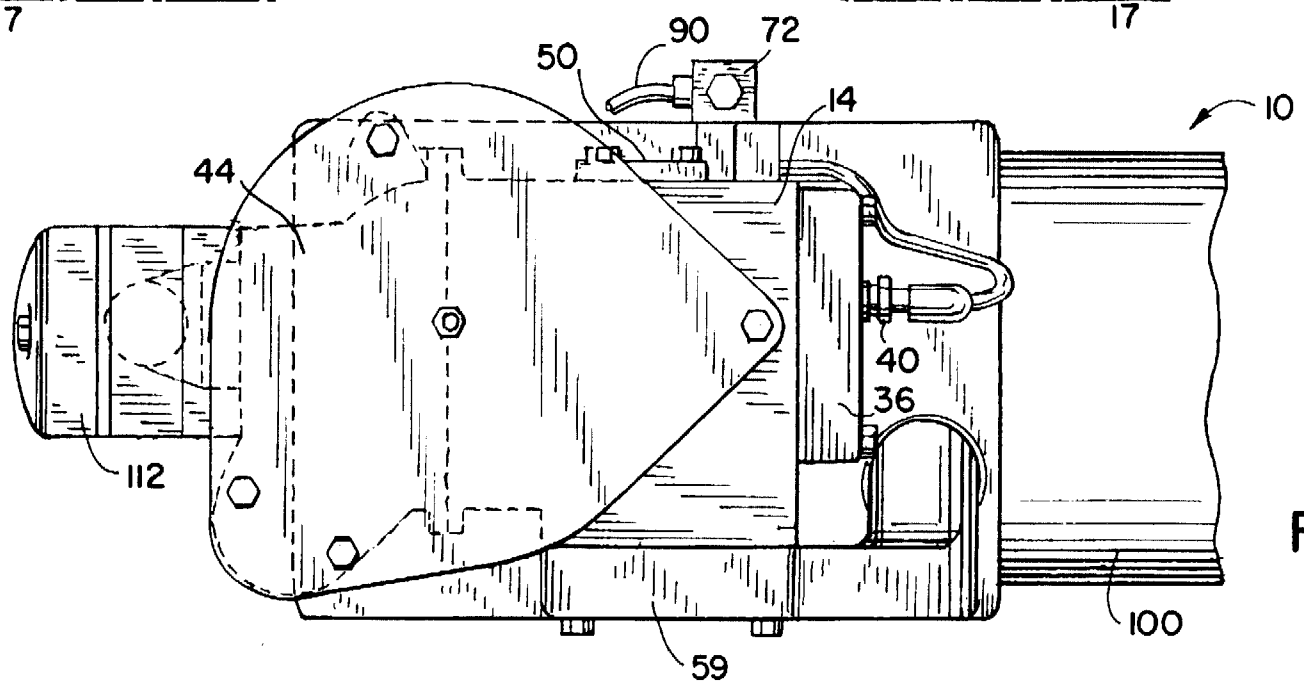
FIG. 10 is a view taken along line 10—10 in FIG. 9.
Figure 11:
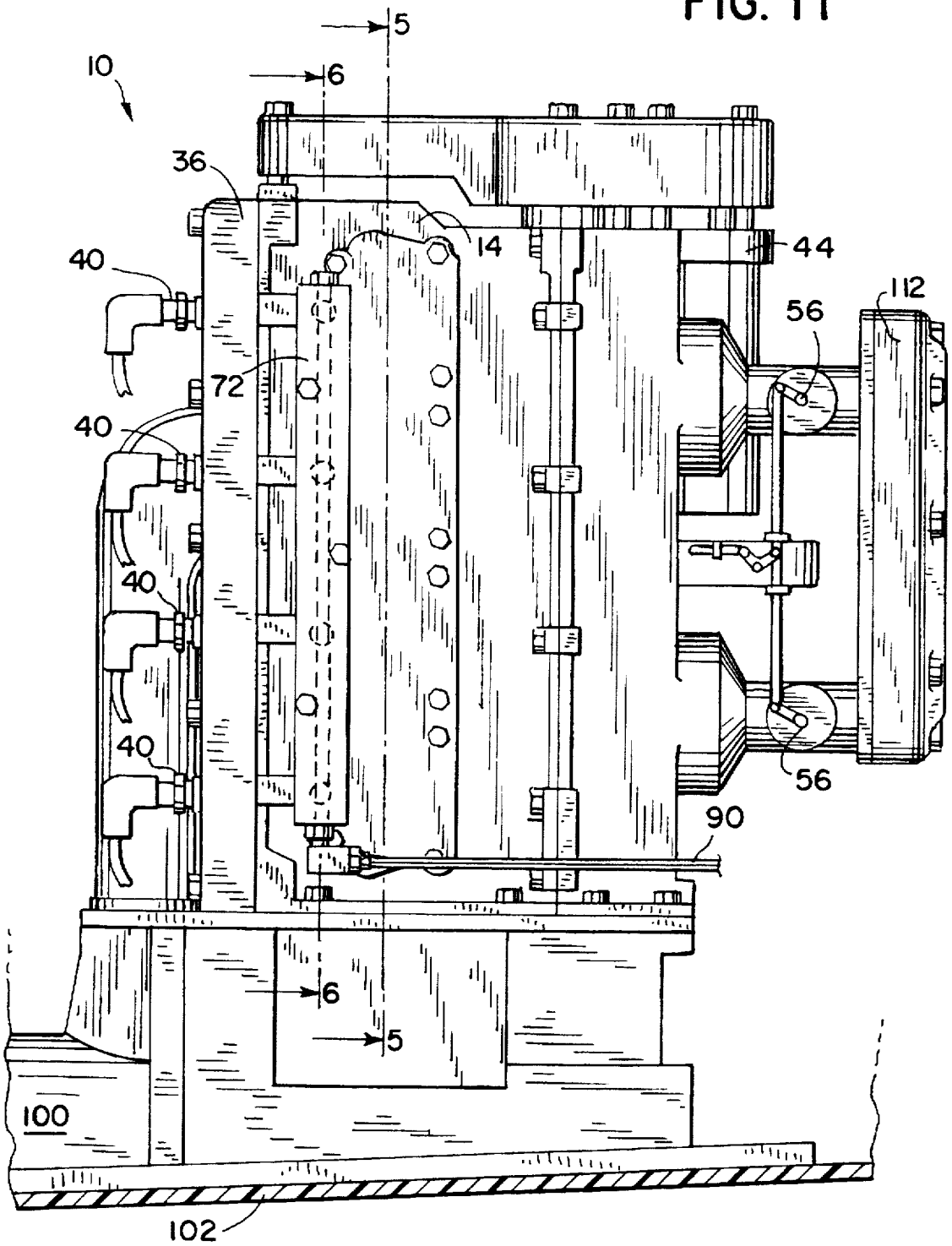
FIG. 11 is a view taken along line 11—11 in FIG. 10.

FIGS. 10 and 11 show the four-cylinder, cross-scavenged engine 10 mounted to the hull 102 of the watercraft 98 so that the longitudinal cylinder axes 18 are generally parallel with the water. With this configuration, the fuel injector 68 and straight fuel rail 72 are easily assessable from the side of the engine 10. This facilitates assembly and the disassembly for service and maintenance of the cylinder wall fuel injection system. An air intake plenum 112 is couple to the engine 10. Each cylinder has a throttle body 56 that regulates the amount of air flowing through the air intake plenum 112 into the respective cylinder.

Figure 12:
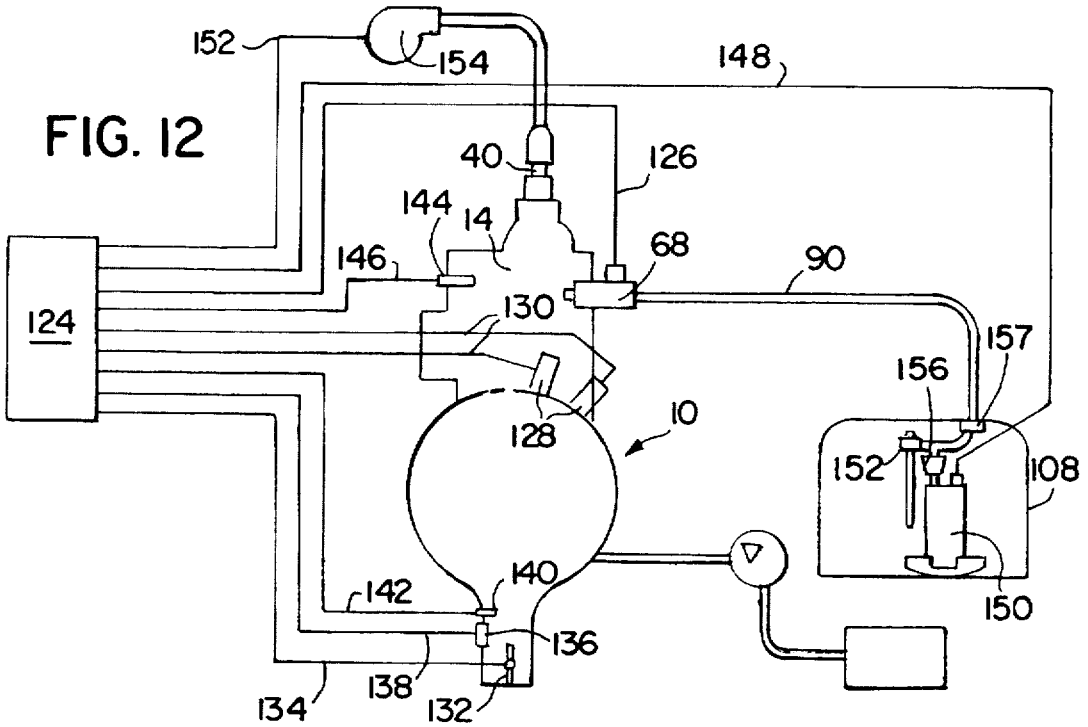
FIG. 12 is a schematic diagram illustrating the low-pressure fuel supply system and the cylinder wall fuel injection system for the watercraft depicted in FIGS. 9 through 11.

FIG. 12 schematically illustrates an electronic control unit 124 controlling the operation of the engine 10 and the watercraft 98. The electronic control unit 124 transmits a control signal through line 126 to fuel injector 68 to control fuel injection timing of the fuel injector 68. The electronic control unit 124 contains a matrix of fuel requirements, spark advance (firing timing), and an injection timing that depend primarily on throttle opening and engine speed but can be modified depending upon ambient conditions as well as other factors. Engine speed is preferably measured using crankshaft position sensors 128 which transmit signals through lines 130 to the electronic control unit 124. The electronic control unit 124 can determine engine RPM from the signals from the crankshaft position sensors 128. Throttle position is monitored using a throttle position sensor 132 which transmits a signal through line 134 to the electronic control unit 124. A manifold air pressure sensor 136 measures the air pressure in the intake manifold and transmit a signal through line 138 to the electronic control unit 124. A temperature sensor 140 senses a temperature of intake air in the manifold and transmits a signal through line 142 to the electronic control unit 124. Another temperature sensor 144 senses the temperature of engine coolant flowing through the engine block 14 and transmits a signal through line 146 to the electronic control unit 124. In response to signals inputting the electronic control unit 124 through lines 130, 134, 138, 142 and 146, the electronic control unit 124 transmits a signal in line 126 to control the operation of fuel injectors 68, as well as control signals through lines 148 to control the operation of a fuel pump 150, and line 152 to control the timing of ignition coil 154 which provides energy to fire spark plug 40.

It is preferred that the electronic control unit 124 control the fuel pump 150 located in fuel tank 108 so that the fuel pump operates only when the engine is running. The fuel pump 150 pumps fuel (preferably between 36 and 100 psi—lower fuel pressures such as 40 to 60 psi maybe desirable to reduce pump 150 heat generation) into pressurized fuel line 90 leading to the fuel rail 72. The fuel pump 150 is preferably a continuous duty pump, although a pulse width modulated pump can be used if desired. A pressure regulator 152 communicates with the pressurized fuel line 90 to regulate the pressure in the pressurized fuel line 90. The pressure regulator 152 is also located in the fuel tank 108 so that excessive fuel remains in the fuel tank 108. Although the fuel pump 150 is preferably a continuous duty pump, it should not be necessary to cool the fuel and/or the pump because the fuel in the fuel tank 108 should be sufficient to eliminate the need for auxiliary fuel cooling. A fuel filter 156 is located in the pressurized fuel line 90 downstream of the fuel pump 150 and upstream of the location where the pressure regulator 152 communicates with the pressurized fuel line 90. A pressure sensor 157 senses the fuel pressure in a pressurized fuel line 90 downstream of the location where the pressure regulator 152 communicates with the pressurized fuel line 90. The pressure sensor outputs a signal that can be monitored by the electronic control unit 124. If the signal from pressure sensor 157 indicates that fuel pressure in line 90 is less than normal operating pressure by a threshold amount, such as 5 psi, the electronic control unit can limit spark advance, thus protecting the engine 10 from failure.

Figure 13:
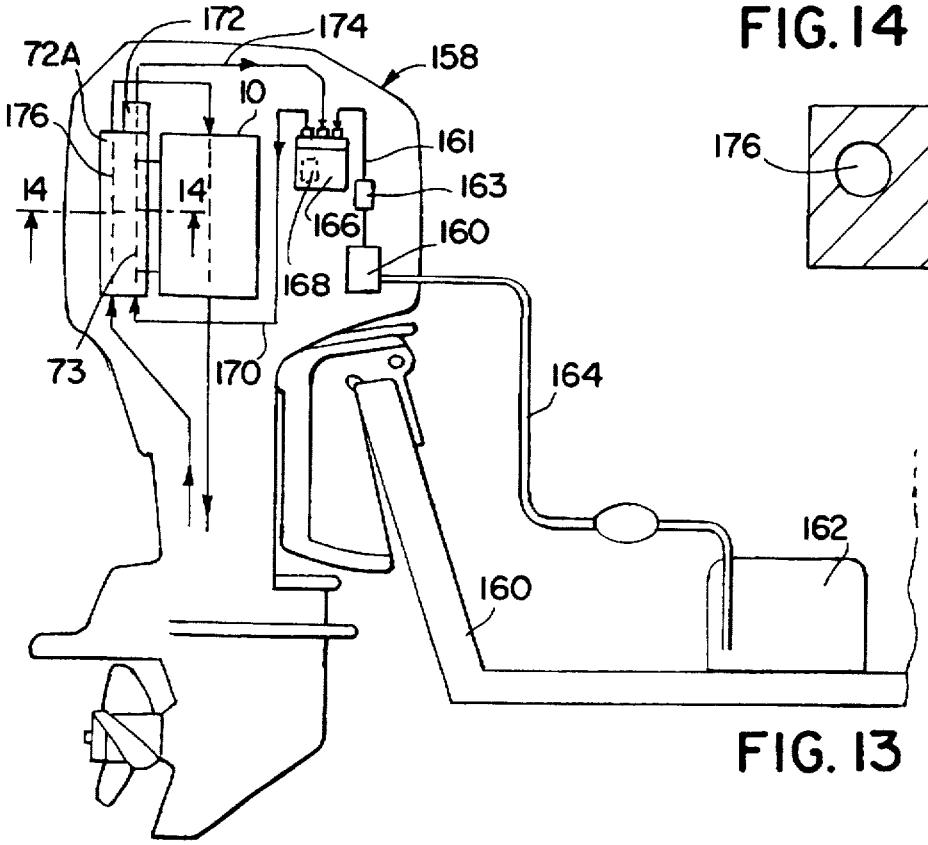
FIG. 13 is a schematic view in accordance with the invention illustrating a low-pressure fuel supply system for an outboard motor having a cross-scavenged, two-cycle internal combustion engine which has a continuous duty pump and a fuel rail that is cooled.
Figure 14:
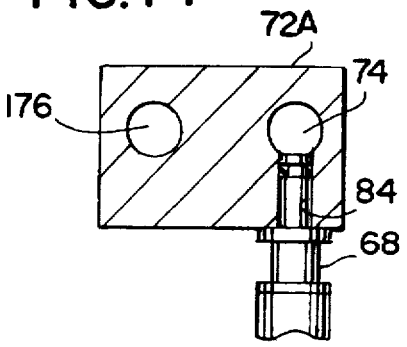
FIG. 14 is a view taken along line 14—14 in FIG. 13.

FIGS. 13 and 14 schematically illustrate the use of engine 10 described in FIGS. 1 through 8 in an outboard motor 158. FIG. 13 shows an outboard motor 158 mounted to the transom 160 of a boat. The engine 10 in FIG. 13 has a vertical crankshaft and horizontal cylinders. A fuel tank 162 is located within the boat, and an unpressurized fuel line 164 is removably connected to the outboard motor 158 as is well known in the art. Fuel from the fuel tank 162 is sucked into the outboard motor 158 through the unpressurized fuel line 164 by a first pump 160. The first pump 160 is preferably a diagram pump which is driving by oscillating pressure in the crankcase of the engine 10 as is known in the art. The first fuel pump 160 pumps fuel through line 161 at a relatively low-pressure to a fuel reservoir 164. A fuel filter 163 is located in the fuel line 161. A second fuel pump 168 is located in a fuel reservoir 166 and provides pressurized fuel (e.g., 36 to 100 psi) through pressurized fuel line 170 to fuel rail 72A. In FIG. 13, the second fuel pump 168 is a continuous duty pump. The fuel rail 72A includes common fuel supply canal 74 and separate dedicated canals 84 for each of the fuel injector 68 as describe earlier in conjunction with FIGS. 5 through 8. A pressure regulator 172 is provided in series with the fuel supply canal 74 downstream of the fuel injectors 68 to regulate the pressure within the fuel supply canal 74 in the fuel rail 72A, preferably between 36 to 100 psi. Excessive fuel from the pressure regulator 172 returns to the fuel reservoir 166 via return line 174. The preferred fuel reservoir 166 and second fuel pump 168 is disclosed in U.S. Pat. No. 5,103,793, entitled "Vapor Separator Internal Combustion Engine", by Steven B. Riese and James Hubbel, issued on Apr. 14, 1992 and assigned to the assignee of the present application, which is incorporated by reference herein. Inasmuch as the second fuel pump 168 is a continuous duty pump, it may be desirable to cool the fuel pump 168 so that the fuel pump 168 does not heat the fuel which can cause fuel pumping vapor problems. A suitable way of cooling the fuel pump is to provide a housing around the body of the fuel pump 168 and flowing coolant around the body of the pump 168 by flowing coolant through the housing. Alternatively, it may be desirable to cool the fuel flowing through the fuel rail 72A to reduce fuel pumping problems. Fuel rail 72A thus includes a cooling duct 176 that provides a path for cooling media, such as cooling water, to flow through the fuel rail 72A to cool the fuel flowing through the fuel rail 72A. As shown in FIG. 13, cooling water exiting the fuel rail 72A can then be used to cool the engine, although this is not necessary.

FIGS. 15 and 16 show a fuel supply system for an outboard motor 159 which is similar many respects to the system 158 shown in FIGS. 13 and 14, except in-line fuel cooler 175 is located in the fuel return line 174 between pressure regulator 172 and a fuel reservoir 166 to cool the fuel rather than providing the cooling duct in the fuel rail 72. In other respects, the system shown in FIG. 15 is similar to the system shown in FIG. 13 in like reference numerals are used to facilitate understanding. The in-line fuel cooler 175 is preferably a tube-in-tube heat exchanger having an inner tube 177 and an outer tube 179. It is preferred that the cooling water flow through the inner tube 177, and fuel flow between the inner tube and the outer tube 179.

FIG. 17 illustrates an outboard motor 158A in which the second fuel pump 168A located in the fuel reservoir 166 is not a continuous duty pump. In FIG. 17, an electronic control unit preferably controls the operation of the second pump 168A and fuel reservoir 166 via pulse width modulation. The second pump 168A operates intermittently when the engine is running at low and medium speeds to maintained suitable pressure in line 170 and the fuel rail 72 for the fuel injector 68. The system shown in FIG. 17 does not require a pressure regulator downstream of the fuel rail 72, a return line from the fuel line 72 to the fuel reservoir 166, nor means for cooling the fuel.

Various modifications, alternatives in equivalence to the invention may be apparent to those skilled in the art. Such modifications, alternatives and equivalent should be considered to come within the scope of the following claims.

I claim:

1. A cross-scavenged, two-cycle internal combustion engine comprising:

a cylinder block having at least one combustion cylinder which defines a piston cavity of cylindrical shape around a longitudinal cylinder axis;

a cylinder head connected to the cylinder block to define a combustion chamber that is in communication with the piston cavity;

a spark plug mounted through the cylinder head so that a spark plug ignition electrode is exposed to the combustion chamber;

a piston that reciprocates longitudinally through the piston cavity along the cylinder axis, the piston having a piston crown with a deflector extending from the piston crown towards the combustion chamber;

a crankcase connected to the cylinder block to define a charging chamber that is in communication with the piston cavity on the side of the piston opposite the combustion chamber;

a plurality of exhaust ports passing through a wall of the combustion cylinder on a first side of the longitudinal cylinder axis;

a transfer passage and a plurality of transfer ports passing from the charging chamber into the portion of the piston cavity communicating with the combustion chamber, the transfer ports passing through the combustion cylinder wall on a second side of the cylinder axis and being directed so air flows through the transfer ports into the piston cavity generally in the direction of the one or more exhaust ports and is redirected towards the spark plug ignition electrode by the deflector on the piston crown;

a fuel injector passing through the wall of the combustion cylinder on the second side of the cylinder axis and having a spray axis that enters through the combustion cylinder wall at a distance from top dead center that is farther than a minimum distance between a top edge of one of the exhaust ports and top dead center, wherein the fuel injected into the piston cavity by the fuel injector is sprayed from the fuel injector into the piston cavity so that a substantial portion of the fuel impinges the piston crown on the deflector in liquid form, becomes vaporized and is convected towards the spark plug ignition electrode in the combustion chamber by scavenging air flowing over the deflector from the transfer ports towards the combustion chamber; and an electronic control unit that controls the operation of the fuel injector.

2. A cross-scavenged, two-cycle internal combustion engine comprising:

a cylinder block having at least one combustion cylinder which defines a piston cavity of the cylindrical shape around a longitudinal cylinder axis;

a cylinder head connected to the cylinder block to define a combustion chamber that is in communication with the piston cavity;

a spark plug mounted through the cylinder head so that a spark plug ignition electrode is exposed to the combustion chamber;

a piston that reciprocates longitudinally through the piston cavity along the cylinder axis, the piston having a piston crown with a deflector extending from the piston crown towards the combustion chamber;

a crankcase connected to the cylinder block to define a charging chamber that is in communication with the piston cavity on the side of the piston opposite the combustion chamber;

a plurality of exhaust ports passing through a wall of the combustion cylinder on a first side of the longitudinal cylinder axis;

a transfer passage and a plurality of transfer ports passing from the charging chamber into the portion of the piston cavity communicating with the combustion chamber, the transfer ports passing through the combustion cylinder wall on a second side of the cylinder axis and being directed so air flows through the transfer ports into the piston cavity generally in the direction of the one or more exhaust ports and is redirected towards the spark plug ignition electrode by the deflector on the piston crown;

a first fuel injector passing through the wall of the combustion cylinder on the second side of the cylinder axis and having a spray axis that enters through the combustion cylinder wall at a distance from top dead center that is farther than a minimum distance between a top edge of one of the exhaust ports and top dead center;

a second fuel injector passing through the wall of the combustion cylinder on the second side of the cylinder axis also having a spray axis that enters through the combustion cylinder wall at a distance from top dead center that is farther than a minimum distance between a top edge of one of the exhaust ports and top dead center; and an electronic control unit that controls the operation of the fuel injector.

3. The engine as recited in claim 1 wherein the spray axis of the fuel injector is directed at an angle between positive 10 degrees and negative 5 degrees with respect to a plane normal to the longitudinal cylinder axis.

4. The engine as recited in claim 3 wherein the spray axis of the fuel injector is directed in a direction parallel with the plane normal to the longitudinal cylinder axis.

5. The engine as recited in claim 1 wherein the fuel injector is mounted through the cylinder wall so that the spray axis of the fuel injector is perpendicular to the longitudinal cylinder axis.

6. The engine as recited in claim 1 further comprising:

a throttle body;

an air intake plenum;

and a one-way valve;

wherein fresh air is supplied to the charging chamber through the throttle body, the air intake plenum, and the one-way valve.

7. The engine as recited in claim 1 wherein the pressure fuel supply to the fuel injector is between 36 and 100 psi.

8. The engine as recited in claim 1 wherein the exhaust ports are located closer to top dead center than the transfer ports so that the piston uncovers the exhaust ports before it uncovers the transfer ports as the piston moves from top dead center to bottom dead center.

9. A cross-scavenged, two-cycle internal combustion engine having multiple cylinders comprising:

a cylinder block having a plurality of combustion cylinders each defining a piston cavity of cylindrical shape around a longitudinal cylinder axis, and each longitudinal axis being parallel to the other longitudinal cylinder axis;

a cylinder head connected to the cylinder block to define a separate combustion chamber for each piston cavity;

a spark plug for each piston cavity mounted through the cylinder head so that an ignition electrode for the spark plug is exposed to the combustion chamber in communication with the piston cavity;

a piston for each combustion cylinder that reciprocates longitudinally through the piston cavity along the longitudinal cylinder axis, each piston having a piston crown with a deflector extending from the piston crown towards the combustion chamber;

a crankcase connected to the cylinder block to define a charging chamber for each piston cavity on the side of the piston opposite the combustion chamber for each piston;

a plurality of exhaust ports for each piston cavity passing through a wall of the combustion chamber on a first side of the longitudinal cylinder axis;

a transfer passage and a plurality of transfer ports for each piston cavity passing from the charging chamber into the portion of the piston cavity communicating with the combustion chamber, the transfer ports passing through the combustion cylinder wall on a second side of the longitudinal cylinder axis and being directed so that air flows through the transfer ports into the piston cavity generally in the direction of the exhaust ports and is redirected towards the spark plug ignition electrode by the deflector on the piston crown;

a fuel injector for each piston cavity passing through the wall of the combustion cylinder on the second side of the longitudinal cylinder axis and having a spray axis that enters through the combustion cylinder wall at a distance from top dead center that is farther than a minimum distance between a top edge of one of the exhaust ports and top dead center and that is parallel to the spray axes of the fuel injectors for the other piston cavities, each fuel injector having a top end that is coplanar with the top ends of the other fuel injectors;

a straight fuel rail that provides pressurized fuel to each of the plurality of fuel injectors at a substantially constant pressure with respect to atmospheric pressure; and an electronic control unit that controls the operation of the fuel injectors.

10. The engine recited in claim 9 further comprising:

an air intake plenum having a single inlet and a separate outlet for each charging chamber;

a throttle body that modulates the amount of fresh air flowing into the air intake plenum; and one-way valve means for preventing air from back-flowing through the air intake plenum.

11. The engine recited in claim 9 wherein each of the fuel injectors are top-fed fuel injectors and the straight fuel rail includes a common straight canal and separate dedicated canals for each fuel injector that are perpendicular to the common straight canal.

12. The engine recited in claim 9 wherein each fuel injector is mounted through the cylinder wall so that the spray axis of the fuel injector is perpendicular to the respective longitudinal cylinder axis.

13. The engine recited in claim 9 wherein each fuel injector is positioned so that the spray axis of the fuel injector is directed at an angle between positive 10 degrees and negative 5 degrees with respect to a plane normal to the longitudinal cylinder axis.

14. The engine recited in claim 13 wherein each fuel injector is positioned so that the spray axis of the fuel injector is parallel to the plane normal to the longitudinal cylinder axis.

15. The engine recited in claim 9 wherein the pressure within the fuel rail is between 36 and 100 psi.

16. The engine recited in claim 9 wherein the fuel rail is secured to the cylinder block with the fuel injectors disposed there between.

17. The engine recited in claim 9 wherein the fuel injector is positioned so that the spray axis of the fuel injector passes through the cylinder wall at a location farther from top dead center than the minimum distance between a top edge of one of the exhaust ports and top dead center.

18. A cross-scavenged, two-cycle internal combustion engine having multiple cylinders comprising:

a cylinder block having a plurality of combustion cylinders each defining a piston cavity of cylindrical shape around a longitudinal cylinder axis, and each longitudinal axis being parallel to the other longitudinal cylinder axes;

a cylinder head connected to the cylinder block to define a separate combustion chamber for each piston cavity;

a spark plug for each piston cavity mounted through the cylinder head so that an ignition electrode for the spark plug is exposed to the combustion chamber in communication with the piston cavity;

a piston for each combustion cylinder that reciprocates longitudinally through the piston cavity along the longitudinal cylinder axis, each piston having a piston crown with a deflector extending from the piston crown towards the combustion chamber;

a crankcase connected to the cylinder block to define a charging chamber for each piston cavity on the side of the piston opposite the combustion chamber for each piston;

a plurality of exhaust ports for each piston cavity passing through a wall of the combustion chamber on a first side of the longitudinal cylinder axis;

a transfer passage and a plurality of transfer ports for each piston cavity passing from the charging chamber into the portion of the piston cavity communicating with the combustion chamber, the transfer ports passing through the combustion cylinder wall on a second side of the longitudinal cylinder axis and being directed so that air flows through the transfer ports into the piston cavity generally in the direction of the exhaust ports and is redirected toward the spark plug ignition electrode by the deflector on the piston crown;

a first fuel injector for each piston cavity passing through the wall of the combustion cylinder on the second side of the longitudinal cylinder axis and having a spray axis that is parallel to the spray axes of the fuel injectors for the other piston cavities, each fuel injector having a top end that is coplanar with the top ends of the other fuel injectors;

a second fuel injector for each piston cavity passing through the wall of the combustion cylinder on the second side of the longitudinal cylinder axis and having a spray axis that is parallel to the spray axis of the first fuel injector for the piston cavity and also parallel to the spray axes of the fuel injectors for the other piston cavities, the second fuel injector also having a top end that is coplanar with the top ends of the other fuel injectors;

a straight fuel rail that provides pressurized fuel to each of the plurality of fuel injectors; and an electronic control unit that controls the operation of the fuel injectors.

19. The engine recited in claim 18 wherein each of the fuel injectors are top fed fuel injectors and the straight fuel rail includes a common straight canal and separate dedicated canals for each fuel injector that are perpendicular to the common straight canal.

20. The engine recited in claim 18 wherein each fuel injector is positioned so that the spray axis of the fuel injector is directed at an angle between a positive 10 degrees and negative 5 degrees with respect to a plane normal to a longitudinal cylinder axis.

21. The engine recited in claim 18 wherein the pressure within the fuel rail is between 36 to 100 psi.

22. The engine recited in claim 18 wherein the fuel rail is secured to the cylinder block with all of the fuel injectors disposed therebetween.

* * * * *